US009303471B2

(12) United States Patent
Schad

(10) Patent No.: US 9,303,471 B2
(45) Date of Patent: Apr. 5, 2016

(54) ROD MAGAZINE

(71) Applicant: TRACTO-TECHNIK GmbH & Co. KG, Lennestadt (DE)

(72) Inventor: Walter Schad, Wernau (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 23 days.

(21) Appl. No.: 14/253,401

(22) Filed: Apr. 15, 2014

(65) Prior Publication Data

US 2014/0332483 A1 Nov. 13, 2014

(30) Foreign Application Priority Data

Apr. 15, 2013 (DE) ..... 10 2013 006 344

(51) Int. Cl.
*E21B 19/14* (2006.01)
*E21B 19/15* (2006.01)

(52) U.S. Cl.
CPC ..... *E21B 19/15* (2013.01)

(58) Field of Classification Search
CPC ..... E21B 19/15; E21B 19/14; E21B 19/155; E21B 19/20; A47B 81/007; A47B 81/005; A47B 81/00; A47B 57/58; A47B 57/583; A47B 65/10; A47B 65/15; A47F 7/281; A47F 7/007; A47F 7/0014; A47F 7/141; A47F 7/0028; A47F 7/0021; A47F 7/0035; A47F 5/005; A47F 5/132; A47F 7/144
USPC ..... 211/70.4, 59.4, 60.1, 49.1, 184, 59.2, 211/175, 4.14, 41.15, 41.18, 43; 414/22.54, 414/22.65, 22.51, 22.62, 22.63, 22.71
See application file for complete search history.

(56) References Cited

U.S. PATENT DOCUMENTS

| | | | | |
|---|---|---|---|---|
| 3,145,786 | A * | 8/1964 | O'Neill et al. | 175/85 |
| 3,501,027 | A * | 3/1970 | Dea et al. | 414/542 |
| 3,563,392 | A * | 2/1971 | Wilson | 211/70.4 |
| 3,612,286 | A | 10/1971 | Langowski et al. | |
| 3,768,663 | A * | 10/1973 | Turner et al. | 211/70.4 |
| 5,154,299 | A * | 10/1992 | Hwang | 211/11 |
| 5,287,974 | A * | 2/1994 | Buday | 211/184 |
| 5,664,691 | A * | 9/1997 | Boivin-Paradis | 211/184 |
| 5,924,577 | A * | 7/1999 | Gessert | 211/41.1 |
| 6,179,065 | B1 * | 1/2001 | Payne et al. | 175/24 |
| 6,237,703 | B1 * | 5/2001 | Draney et al. | 175/162 |
| 6,845,825 | B2 * | 1/2005 | Bischel et al. | 175/24 |
| 6,966,106 | B1 * | 11/2005 | Roodenburg et al. | 29/407.01 |
| 7,240,742 | B2 * | 7/2007 | Sewell et al. | 175/52 |
| 7,562,724 | B2 * | 7/2009 | Allred et al. | 175/85 |
| 7,922,012 | B2 * | 4/2011 | Sisley | 211/60.1 |
| 8,261,921 | B2 * | 9/2012 | Anscomb et al. | 211/189 |
| 8,875,909 | B2 * | 11/2014 | Gerkensmeier et al. | 211/175 |

(Continued)

*Primary Examiner* — Jennifer E Novosad
(74) *Attorney, Agent, or Firm* — Howard IP Law Group

(57) ABSTRACT

A rod magazine for accommodating rod linkages for a drilling device having a frame including elongated bars connected so as to define a quadrangular space. First and second end plates are attached to respective ends of the frame. A first head is releasably attached to the first end plate and includes a plurality of separating elements. A second head is releasably attached to the second end plate and comprises a plurality of separating elements. Each of the plurality of separating elements of the first and second heads are variably positioned relative to an adjacent one so as to define a plurality of separating rows, wherein each separating row is configured to receive one or more ends of rod linkages within the interior of the frame.

10 Claims, 2 Drawing Sheets

(56) References Cited

U.S. PATENT DOCUMENTS

2003/0190227 A1* 10/2003 Trpkovski ..... 414/796.9
2004/0022605 A1 2/2004 Anthis et al.
2010/0104401 A1* 4/2010 Hopkins et al. ..... 414/22.54
2011/0200413 A1* 8/2011 Hermes et al. ..... 414/22.62
2014/0332483 A1* 11/2014 Schad ..... 211/70.4

* cited by examiner

ROD MAGAZINE

FIELD OF THE INVENTION

The invention relates to a rod magazine for a drilling device, a system, and a drilling device.

BACKGROUND

With ground drilling, a common practice is to string individual rod linkages to one another. The rod linkages are connected to one another and moved through the ground with the assistance of a push, pull, or rotary drive. With longer bores or with trenchless routing over long distances, the rod consists of multiple rod linkages, which are connected together or separated from one another, bit by bit, depending on the progress of the drilling.

To supply the rod linkages, a rod magazine may be provided to accommodate a plurality of rod linkages. A rod linkage may be provided from the rod magazine by means of a transfer device to transfer a rod linkage from the rod magazine and to transfer the rod linkage into the drill pipe axis, which can be defined by the drill carriage. Bores, some of which reach depths of several hundred meters, can be placed with the relatively short rod linkages.

With many drilling devices, the placement of a new rod linkage in the drill pipe is carried out automatically. The rod transfer device in this case can grasp a rod linkage released from the rod magazine and position it in the drill carriage of the drilling device such that the longitudinal axis of the corresponding rod linkage can be arranged coaxially with respect to longitudinal axis of the drill pipe.

In particular, the automation makes it necessary for the rod linkages in the rod magazine to be disposed in defined positions. Different rod magazines are used for providing various rods at various positions. For example, the rod linkages may differ from one another with regard to their outer diameter. Each type of rod linkage normally requires a different rod magazine.

The object of the invention is thus to obtain a rod magazine or a drilling device that can be used to quickly and easily adapt the rod magazine to different types of rods and/or that may be operated with different rod linkages disposed in one rod magazine.

The object is achieved according to the subject matter of the independent claims.

The core of the invention is to obtain a rod magazine for a drilling device in which separating elements are provided whose position is variable. Due to the variability of the positions of the separating elements, the rod magazine can be adapted to the different types of rod linkages, which differ particularly with respect to their diameter. The drilling device may be operated with different types of rod linkages.

SUMMARY

According to the invention, a frame is used that may form a base magazine or a base box in which differing elements of different positions and/or different types and/or number may be disposed. The term "disposed" here, according to the invention, refers to the separating elements being able to be releasably attached to the frame directly or indirectly.

With the frame and the separating elements that are detachably connected directly or indirectly hereto, a rod magazine can be obtained that can be flexibly converted and/or expanded. The rod magazine according to the invention can be issued independently of the order and later put together specifically for the customer's wishes. A smaller storage space may be required.

In particular, the rod magazine and the drilling device may be used in the area of horizontal laying technology. The term "horizontal laying technology," according to the invention, refers to underground horizontal drilling as well as trenchless laying or replacement of pipelines. Within the scope of the invention, the term "drilling" is synonymous with the term "horizontal laying technology." Drilling according to the invention also includes exerting tensile force on a linkage.

A rod magazine according to the invention may be a multi-row rod magazine in which the rows are defined by means of the separating elements. For example, 3 to 6, or particularly 4 to 5, rows are preferred. A frame according to the invention may define a quadrangular space at whose corners side beams, which are affixed and/or at least fastened directly to one another by means of crossbeams and/or struts may be arranged in the longitudinal extension to form the defined quadrangular space. The terms "struts" and "crossbeams" may be used synonymously with respect one another. The frame may be in a truss-like design made of rods, which are designed as beams or carriers, which are connected to one another at both ends.

In particular, the side beams can be aligned parallel and spaced apart from one another. The quadrangular space can be open on one side, in particular on three sides, over the entire length (without struts in the rectangular area of the side); one of the sides can form the opening of the rod magazine through which the rod magazine may be accessed; a separating element may be placed in the other two sides. Preferably, the two sides may be the front sides of the quadrangular space (when viewed in the longitudinal direction) for the insertion of a separating element. Especially preferably, at least two side beams may be connected at the front area of an elongated quadrangular space by means of a crossbeam. The crossbeam may, in particular, connect two side beams together, arranged above one another. Crossbeams arranged on the front may especially preferably have a flat extension, transverse with respect to the front side.

The cross-section of the crossbeams may be in any form. The side beams may have a varying cross-section. It may be a round or elongated cross-section that may vary over the length of the side beam. In particular, a cross-section may be selected that is essentially rectangular. The cross-section of the struts may also be selected as desired and may vary over the length. The struts may, particularly, be arranged in one plane that extends between two side beams at which the strut is fastened. The strut may extend at essentially a right angle with respect to the side beams. Preferably, a strut, which connects the base-side side beams, extends at essentially a right angle with respect to the base-side side beams. Struts that connect side beams that span a vertical plane or define a side surface of the quadrangular space—especially preferably if they are not arranged in the front area—may extend at an angle of less than 90° with respect to it, or particularly preferably, less than 80°, or very especially preferably, at an angle of less than 70°. The function of the struts is to retain the side beams at the corner points of the quadrangular space; the base stability of the rod magazine can be obtained by this.

The term separating element, as set forth by the invention, particularly comprises movable and/or replaceable separating bars or inserts that enable "subdivision" within the rod magazine of the mounting space of the rod magazine for the rod linkages. The separating elements in the rod magazine may enable stacking of the rod linkages over one another so that stacking space may be obtained in the rod magazine that corresponds essentially to the width of a rod linkage.

In one embodiment of the invention, the rod magazine may have a frame and at least two separating elements in which the separating elements are arranged on a wall and the wall and/or the separating elements are connected to the frame in a detachable manner. As set forth by the invention, the term "detachable connection" includes the option of connecting the separating elements, the wall, and/or the frame to one another, in which a direct connection to one another is not excluded. In particular, the separating element may be fastened directly to the frame via the wall. This makes it possible, for example, to have separating elements formed on a wall, detachably connected to the frame, which may be used as separating bars in the interior of the rod magazine in order to arrange the rod linkages.

In a preferred embodiment, the wall may be disposed at, at least, one top end of the frame. This enables the separating elements to project into the interior of the rod magazine such that they can extend in the longitudinal direction of the rod magazine in order to obtain a space in the longitudinal direction in which one rod linkage can be stacked on top of the other.

Preferably, the separating elements have a length that is shorter than ⅓ the length of the frame in the longitudinal direction. This enables the separating elements to be designed short, so that the rod linkages to be disposed in the rod magazine can only be in contact with the separating elements at their ends. Thereby, one configuration of the rod linkages is normally sufficient. It may also be provided that the separating elements have differing lengths. The separating elements may also have a length that is shorter than ¼, particularly ⅕, and especially preferably ⅙, the length of the frame in the longitudinal direction. The weight, and also the material, of the rod magazine may be reduced by using short separating elements in the extension of the longitudinal direction of the frame.

In addition, the extension of the separating elements may be adapted to the height of the rod magazine (frame), depending on the type of rod linkage. Normally, rod linkages with a larger diameter, for example, require a separating element that is shorter, because the separating elements essentially only make contact with the separating elements at the center, so that, for the area of the rod linkage above the center of the rod linkage, no material can be used for the separating element.

In a preferred embodiment, the wall encompasses a surface of the frame on at least two edges. This increases the stability of the rod magazine. The torsional flexibility of the frame can be reduced. The wall on which the separating elements may be arranged may extend at least over one edge-side area of a side adjoining the front of the quadrangular space. Preferably, the wall may extend, at least at the edge, over two opposite sides. This increases the stability.

In a preferred embodiment, the wall may be bolted to the frame. Preferably, the bolting is done with bolts whose longitudinal direction extends essentially parallel to the plane of the wall. The bolting can be carried out on a side of the frame other than that of the wall, namely on the side of the frame extending 90° away from the wall.

The invention also obtains a system with walls for a rod magazine having separating elements of varying sizes and/or with various spacings with respect one another and/or a various number of separating elements.

The system may also comprise a wall, particularly for a front end that is designed free of separating elements, with slots into which the separating elements are inserted and with which the wall may be detachably connected directly or indirectly.

Furthermore, the invention provides for a drilling device comprising a rod magazine according to the invention.

The aforementioned explanations, as well as the following description of exemplary embodiments, do not represent any omission of certain embodiments or features.

BRIEF DESCRIPTION OF THE FIGURES

The invention is explained in more detail in the following by means of an exemplary embodiment shown in the drawings.

The drawings show the following.

DETAILED DESCRIPTION

Figure 1:
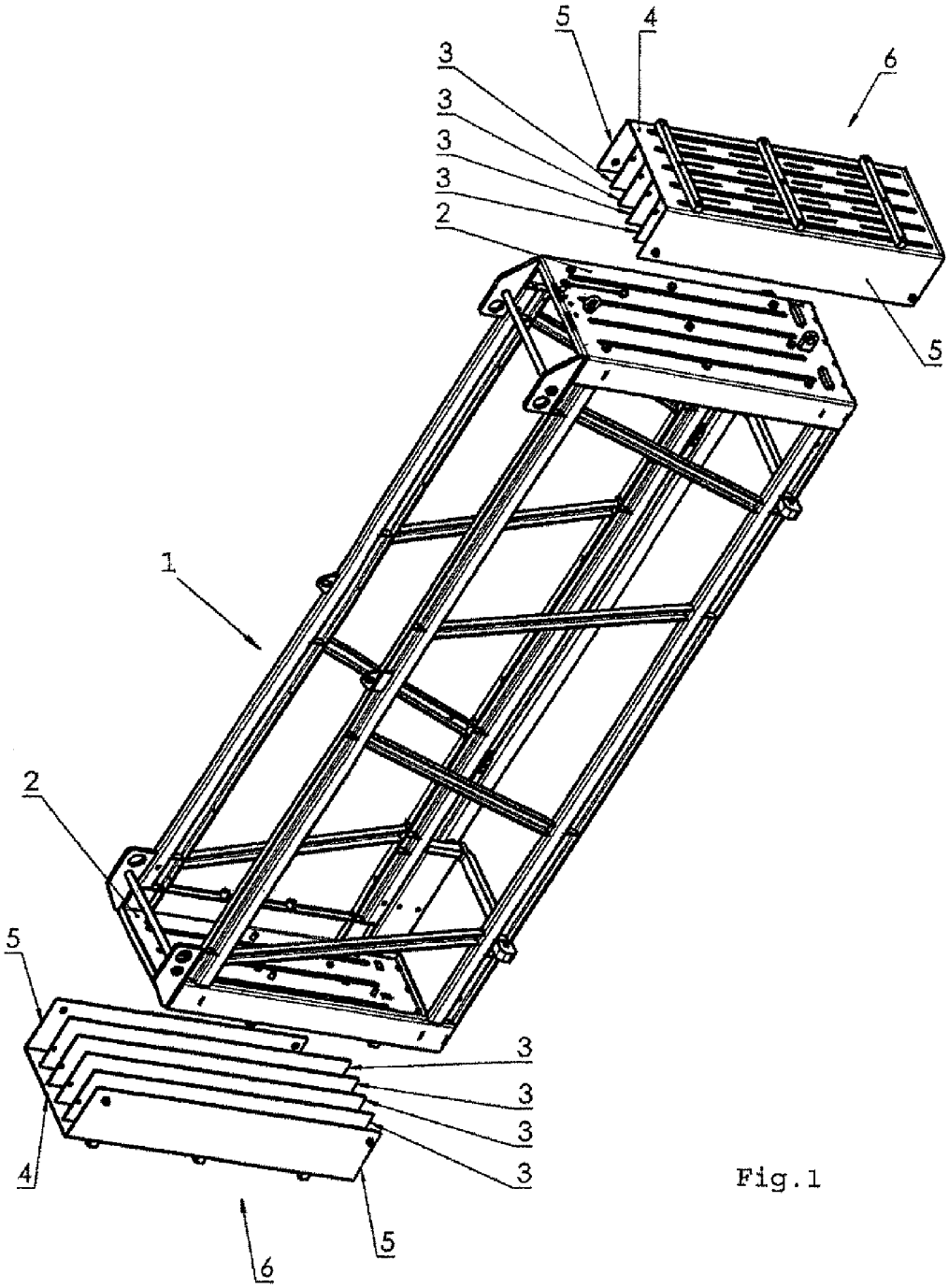
FIG. 1—shows a frame with two removable end caps that may be replaced by walls as set forth by the invention.

FIG. 1 shows a frame 1 for a rod magazine according to the invention. FIG. 1 shows a cap end 2 stabilizing the frame 1, which can be separated from the frame 1, at each head end of the frame 1. If the cap ends 2 are separated from the frame 1, the head ends of the frame are essentially free.

The frame 1 defines a quadrangular space that is elongated and has two front sides at which the (end plates 2) connections 2 are arranged.

FIG. 1 shows separating elements 3, which are disposed in the interior of the frame 1 and form intermediate areas in which one rod linkage may be stacked above the other. In the example shown in FIG. 1, five rod linkages may be disposed next to one another and stacked one on top of the other. The distance between the separating elements 3 in this case corresponds essentially to the diameter of a rod linkage for which the rod magazine should be designed.

The separating elements 3 are arranged on a wall 4 and essentially extend perpendicularly with respect to this wall. There are two sections 5 molded on the wall 4 or formed as a single piece with a wall 4. The sections 5 encompass two edges of the frame when attached to the frame 1. The sections 5 laterally encompass the frame 1. The sections 5 have fastening elements that function together with the sides of the frame 1 and extend perpendicularly with respect to the wall 4. The sections 5 each have two bolts that may be bolted to a section of the respective sides of the frame 1.

Figure 2C:
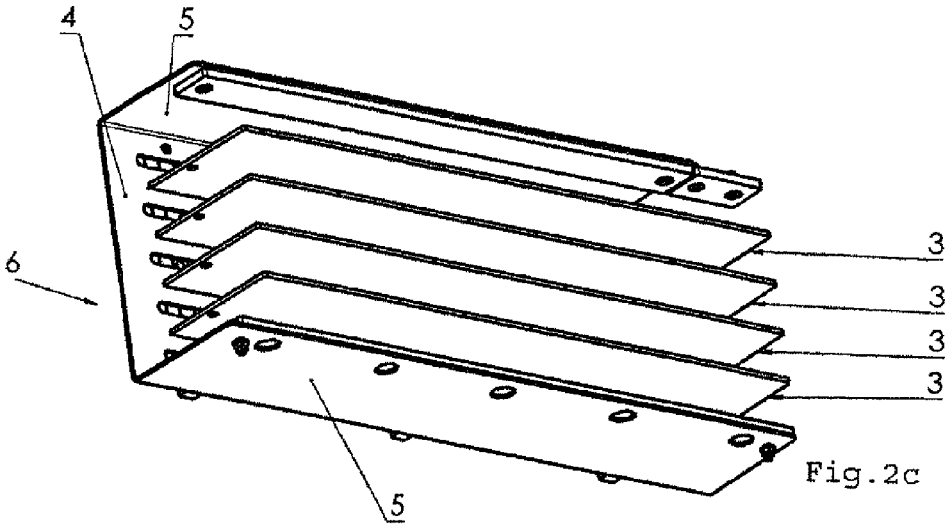
FIG. 2*a,b,c*—shows three walls with separating elements for a system as set forth by the invention.
Figure 2B:
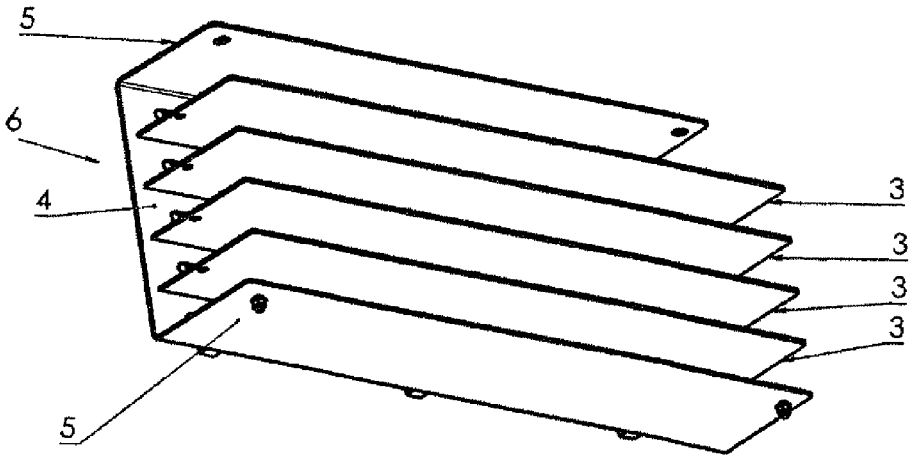
Figure 2A:
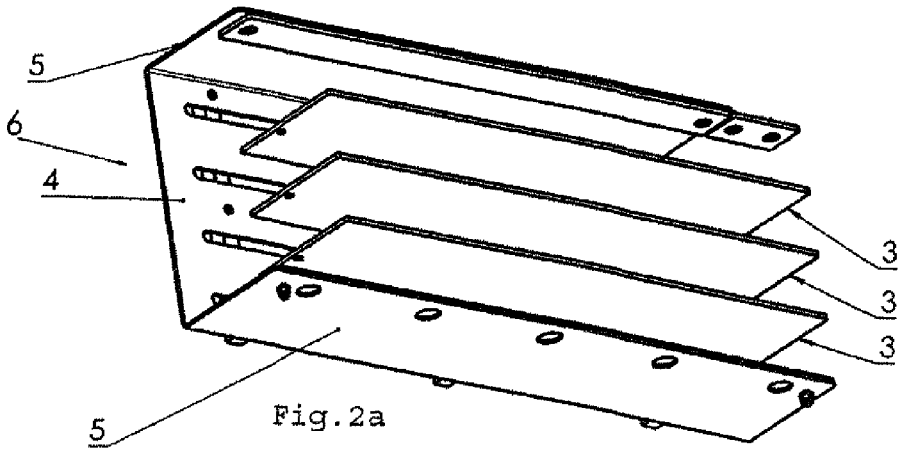

FIG. 2 shows options 2*a*, 2*b*, and 2*c* indicating how the frame 1 shown in FIG. 1 can be configured for different rod linkages. The examples shown in FIGS. 2*a*, 2*b*, and 2*c* of an arrangement of separating elements 3 show a prefabricated arrangement of the wall 4 with sections 5 and separating elements 3 connected to the wall 4. The wall 4 and the sections 5 are essentially designed equally for the three exemplary embodiments shown. What differs is the number and/or the spacing and/or the length of the extension in the height of the separating elements 3. The wall 4, the sections 5, and the separating elements 3 can be prefabricated, as shown in the three exemplary embodiments of FIG. 2, as replaceable head ends 6 in order to adapt the frame 1 to the differing rod linkages to the individual inserts of the head ends 6. For example, the head end 6 shown in FIG. 2*b* can be used for rod linkages having a smaller diameter than the rod linkages with the use of the head end 6 as it is shown in FIG. 2*a*.

The head ends 6 may be placed at the front ends of the quadrangular space defined by the frame 1.

The invention claimed is:

1. A rod magazine for accommodating rod linkages for a drilling device, comprising:

a frame comprising elongated bars connected so as to define a quadrangular space having first and second opposing longitudinal ends;

a first end plate attached to the first end of the frame;

a second end plate attached to the second end of the frame;

a first head releasably attached to the first end plate, the first head comprising a plurality of separating elements, each of the plurality of separating elements variably positioned relative to an adjacent one so as to define a plurality of separating rows, wherein each separating row is configured to receive one or more first ends of rod linkages within an interior of the frame; and a second head releasably attached to the second end plate, the second head comprising a plurality of separating elements, each of the plurality of separating elements variably positioned relative to an adjacent one so as to define a plurality of separating rows, wherein each separating row is configured to receive one or more second ends of rod linkages within the interior of the frame.

2. The rod magazine of claim 1, wherein the first head comprises a first wall releasably attached to the first end plate, and wherein the plurality of separating elements of the first head are disposed on the first wall, and wherein the second head comprises a second wall releasably attached to the second end plate, and wherein the plurality of separating elements of the second head are disposed on the second wall.

3. The rod magazine of claim 2, wherein each of the first wall and the second wall encompass a surface of the frame at, at least, two edges.

4. The rod magazine of claim 1, wherein the separating elements extend in height a distance shorter than ⅓ of the length of the frame in the longitudinal direction.

5. The rod magazine of claim 1, wherein at least some of the plurality of separating elements define different extensions in height.

6. A drilling rod magazine system for accommodating rod linkages for a drilling device, comprising:

an elongated frame member having opposing first and second frame ends and an open interior configured to accommodate rod linkages;

a first end plate attached to the first end of the frame;

a second end plate attached to the second end of the frame;

first and second detachably coupled head ends, the first head end detachably coupled to the first end plate, the second head end detachably coupled to the second end plate, wherein the first detachable head end comprises:

a first wall that detachably covers the first end plate, and separating elements connected to the first wall along a surface thereof, the separating elements extending from the first wall in a longitudinal direction toward the second head end, wherein each of the plurality of separating elements is variably positioned relative to an adjacent one so as to define a plurality of separating rows, each separating row configured to receive one or more first ends of rod linkages within an interior of the frame for conveying to a drilling device, and wherein the second detachable head end comprises:

a second wall that detachably covers the second end plate, and separating elements connected to the second wall along a surface thereof, the separating elements extending from the second wall in a longitudinal direction toward the first head end, wherein each of the plurality of separating elements is variably positioned relative to an adjacent one so as to define a plurality of separating rows, each separating row configured to receive one or more second ends of rod linkages within the interior of the frame for conveying to a drilling device.

7. The system of claim 6, wherein the separating elements of the first and second head ends extend in height a distance shorter than ⅓ of the length of the frame in the longitudinal direction.

8. The system of claim 7, wherein the separating elements of the first and second head ends are disposed so as to define row widths to accommodate one or more rod linkages.

9. The system of claim 7, wherein at least some of the separating elements define different extensions in height.

10. The system of claim 6, wherein each wall of said first and second head ends encompasses a surface of the frame at, at least, two edges.

* * * * *